United States Patent [19]

Krchma et al.

[11] 4,236,951

[45] Dec. 2, 1980

[54] METHOD OF TREATING BLISTERS IN ASPHALTIC MEMBRANE COVERED ROOFS

[76] Inventors: Ludwig C. Krchma, 1168 E. 66th St., Kansas City, Mo. 64113; Paul L. Morris, 8815 W. 104th St., Overland Park, Kans. 66212

[21] Appl. No.: 864,852

[22] Filed: Dec. 27, 1977

[51] Int. Cl.[3] ..... B32B 35/00; B05D 3/12; B05D 1/26

[52] U.S. Cl. ..... 156/71; 106/285; 156/87; 156/94; 156/253; 156/280; 156/305; 156/524; 264/36; 427/140; 427/278; 427/290; 427/307; 427/369

[58] Field of Search ..... 106/278, 285; 156/71, 156/87, 94, 145, 253, 268, 280, 305, 524, 95; 427/140, 230, 278, 290, 307, 369; 264/36

[56] References Cited

U.S. PATENT DOCUMENTS

| | | | |
|---|---|---|---|
| 1,880,429 | 10/1932 | Ford | 156/94 |
| 1,957,732 | 5/1934 | Rowe | 156/87 |
| 2,370,958 | 3/1945 | Hellier | 156/95 X |
| 2,542,721 | 2/1951 | Stafford | 106/278 X |
| 2,847,318 | 8/1958 | Dowlen et al. | 427/140 |
| 3,162,101 | 12/1964 | Rostler | 427/138 |
| 3,211,813 | 10/1965 | Behrendt | 264/36 |
| 3,432,321 | 3/1969 | Rostler | 106/277 |
| 3,729,331 | 4/1973 | Vivian | 427/140 |
| 3,996,396 | 12/1976 | Hansen et al. | 427/140 |
| 4,000,000 | 12/1976 | Mendenhall | 106/280 |
| 4,033,784 | 7/1977 | Lawson et al. | 106/278 X |

*Primary Examiner*—John T. Goolkasian
*Assistant Examiner*—Robert A. Dawson
*Attorney, Agent, or Firm*—Fishburn, Gold and Litman

[57] ABSTRACT

A method of treating asphaltic membrane covered roofs for inhibiting the formation of blisters therein and reducing blisters that have formed therein comprises applying to the blistered portions and surrounding areas of the membrane a quantity of selected liquid hydrocarbon. The selected hydrocarbon is miscible with the asphalt of the membrane to instill self-healing qualities therein.

3 Claims, 6 Drawing Figures

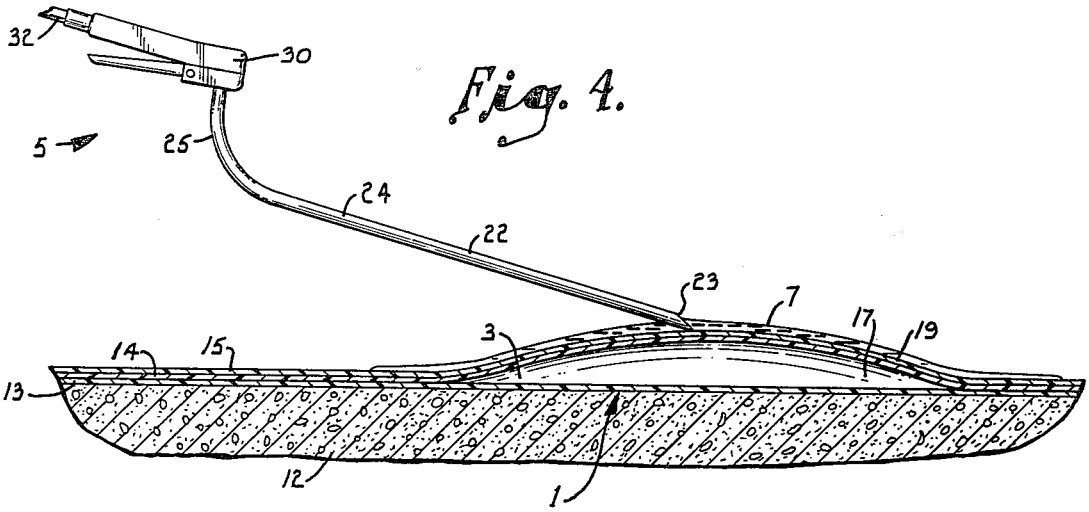
Fig. 4.
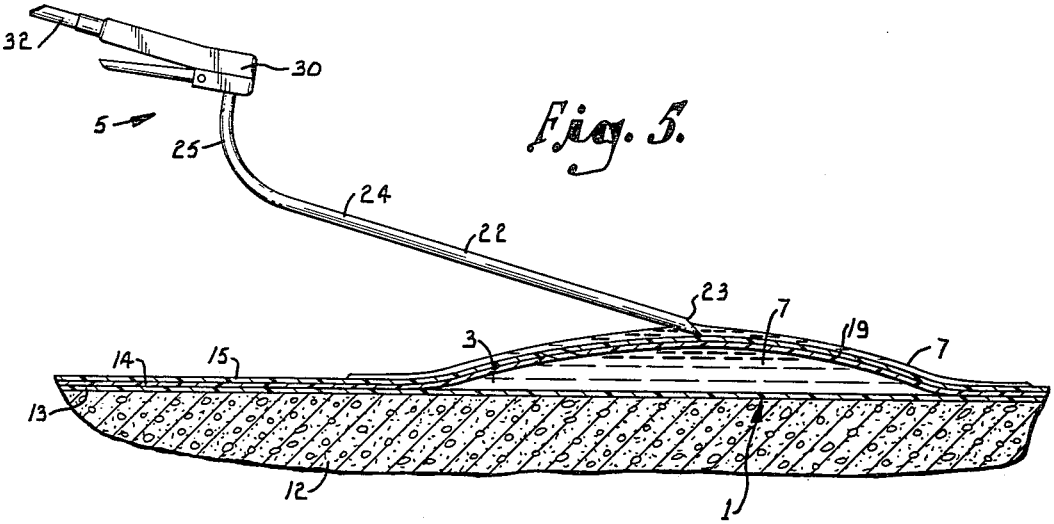
Fig. 5.
Fig. 6.
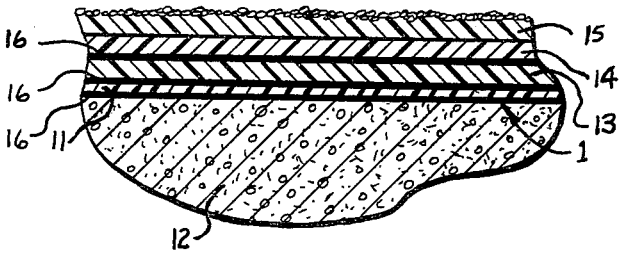

METHOD OF TREATING BLISTERS IN ASPHALTIC MEMBRANE COVERED ROOFS

The invention relates to methods of treating the blistered portions of built-up asphalt roofs.

BACKGROUND OF THE INVENTION

The built-up or layered asphalt roof is commonly used in present construction methods and over two billion square feet of such roofing is installed annually. Some 10 to 15 percent of this total roof area requires additional maintenance for various reasons, one of the most important being the occurrence and growth of blisters therein, which expand and separate the roof plies, creating an unsightly appearance and increasing the risk of injury to the roof.

In a conventional built up asphalt roof construction, for example, a membrane is the basic component thereof and may be composed of at least two felt and asphalt or bitumen plies protected by a top coat of asphalt with mineral aggregate or crushed rock spread thereover. Such a roof is constructed like a multi-deck sandwich, and include a base ply sheet either nailed to the structural roof or cemented thereto with a thin layer of asphalt. On top of the base ply sheet, one or more layers of asphalt impregnated roofing felts are applied as by laying in strips with overlapping edges and cemented down by an asphaltic coating. Finally, a top coat is applied to form the completed membrane and is generally a relatively heavy layer of built up roofing asphalt with the mineral aggregate surface spread thereover. Additionally, such roof construction methods often include a layer of insulating material between the membrane and the structural roof to reduce heat transfer between the exterior and the building interior to which the above membrane is applied.

Blisters pose significant problems for the built-up membrane and are one of the major reasons calling for membrane maintenance. The blisters can range in size from virtually indetectable spongy spots to bloated spaces of one foot in height, and covering as much as fifty square foot in area. This can be caused by heated water vapor entrapped principally between the plies but at times between the substrate and the membrane.

The present invention contemplates applying a quantity of petroleum hydrocarbon to the blistered portions of the roof membrane. The petroleum hydrocarbon is of such a nature, hereinafter described, that in the particular mode of application it penetrates the top coat and softens the separated plies and instills self-healing properties in the asphalt thereof whereby the same can be directed back into rebonding by physical contact.

The principle objects of the present invention are: to provide a method for reduction and repair of blisters in asphalt roofs; to provide such a method which effectively rebonds separated plies; to provide such a treatment which heals cracked top coat roof surfaces; to provide such a treatment wherein a liquid petroleum hydrocarbon is applied to the blistered and weathered portion of roof membranes, thereby penetrating and softening the same and permitting the separated plies or top coat surface cracks to move into rebonding contact; to provide such a treatment softening and instilling proper self-healing properties into the asphalt of the roof membrane whereby the asphalt flows into resealing and rebonding contact under normally encountered temperatures and pressures; to provide such a treatment facilitating ease of maintenance of asphalt roof coverings; and to provide such a method which is relatively inexpensive, highly reliable in use, and well adapted for its intended purpose.

Other objects and advantages of this invention will become apparent from the following description taken in connection with the accompanying drawings wherein are set forth by way of illustration and example certain practices of this invention.

FIG. 4 is a fragmentary sectional view similar to FIG. 3 and illustrating a fluid emitting apparatus applying a quantity of hydrocarbon to a blistered membrane surface.

FIG. 5 is a fragmentary sectional view similar to FIG. 4 and illustrating the application of quantity of hydrocarbon to both the exterior and interior surface of a blister.

FIG. 6 is an enlarged, fragmentary sectional view of a roof membrane and showing certain details thereof.

Figure 1:
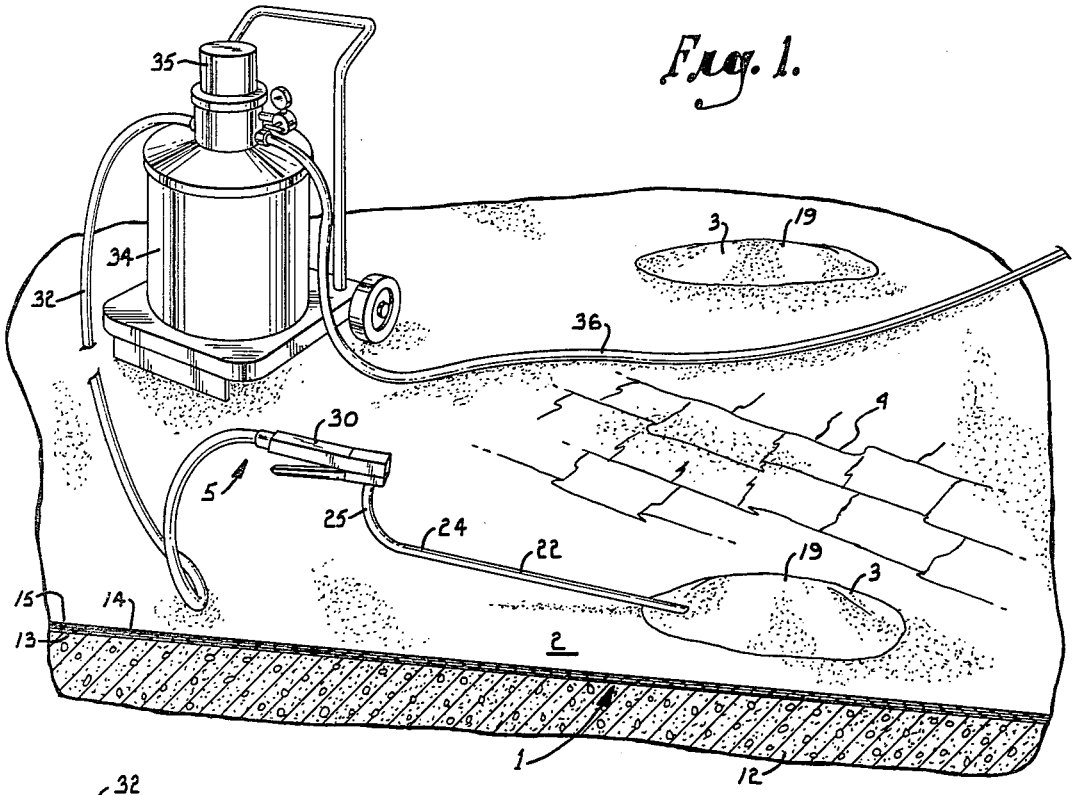
FIG. 1 is a perspective view illustrating a method practicing the present invention and including a pump used in connection therewith.
Figure 2:
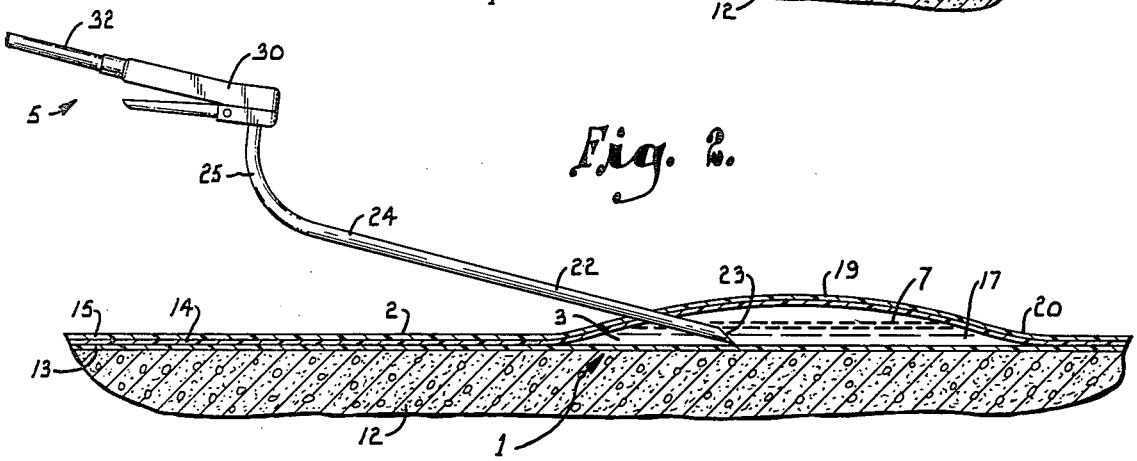
FIG. 2 is a fragmentary sectional view of a roof and membrane thereof and showing a fluid emitting apparatus injecting a quantity of hydrocarbon into a blister void.

Referring more in detail to the drawings:

As required, certain practices of the present invention are disclosed herein, however, it has been understood that the disclosed practices are merely exemplary of the invention which may be practiced in various forms. Therefore, specific structural and functional details disclosed herein are not to be interpreted to be limiting but merely as a basis for the claims and as a representative basis for teaching one skilled in the art to variously employ the present invention in virtually any appropriate situation.

The reference numeral 1 generally designates a section of a representative asphalt or bituminous roof membrane which includes a surface 2 having a plurality of top coat surface cracks 4 and including a blistered portion 3. The membrane 1 overlies the base ply sheet 11, FIG. 6, which is cemented to the structural deck 12 of the building by a mopped layer of asphalt 16. In recent construction methods, a layer of insulating material (not shown) is interposed between the membrane 1 and the structural deck 12 of the building. The membrane 1, in this example, includes a center ply 13 of bitumen-saturated roofing felt cemented by a mopped layer of asphalt 16 to the base ply sheet 11. A top ply 14 of roofing felt is cemented by another layer of asphalt 16 to the underlying ply 13 of roofing felt and is in turn overlain by a top layer or top coat 15 comprised of a relatively thick layer of asphalt with small pebbles or aggregate spread thereover. In the illustrated example, the blister 3 is of the interply type and extends between the center ply 13 and the top ply 14 of roofing felt, separating the plies and thrusting upwardly to form an opening or void 17 therein and a domed top or blistered surface 19 on the outer surface 20 of the membrane 1. The blister void 17 often contains a quantity of pressurized and heated air and water vapor therein which dynamically forces apart the plies 13 and 14. During rainfall, the void 17 can become waterlogged, requiring removal of the water as maintenance is accomplished.

Although there are various theories concerning the cause of blisters, most authorities believe that they are formed as a result of either an air void incorporated during construction of the membrane or by moisture initially in the felts or entering the membrane by means such as percolating downwardly through minute openings or pores in the top coat, entering by capillary action around the surface of the aggregate, or traveling upwardly through the substrate from the building interior. It is believed that the contents of the resulting blisters are air and moisture (water) and that at the higher temperatures of the daily temperature cycle, such as experienced during the summer, the pressure this air-moisture system can develop between the two roof plies 13 and 14 can exceed 300 pounds per square foot of roof area, more than enough to cause the asphalt bonding the plies 13 and 14 to flow and form voids 17 or to increase existing voids. During the low point of the daily temperature cycle, harder grades of asphalt, such as Types III and IV (ASTM D-312-71), in the blistered plies will stiffen sufficiently to resist the flow necessary to accomodate the lower pressures and reduction in the void size. This creates a partial vacuum which draws additional air into the blister void 17 which proceeds to increase the blister size during the next increase in temperature.

The present invention recognizes and promotes factors which counter the growth of blisters. These counter-effects become significant where the asphalt in the blistered ply has sufficient cold flow during the lower part of the temperature cycle to allow the blister to subside and heal. Blisters are not as prevalent in roofs having slopes of less than 1 inch to the foot when built with asphalts recognized as self-healing, such as Type I ASTM D-312 and to a lesser degree Type II. These membranes are not as prone to blistering as identical roofs having more flow-resistant and non-healing harder grades of asphalt such as Type III and IV (ASTM D-312-71).

Surface cracks 4, commonly called alligator cracks, are also more prevalent in the built-up roof asphalt top coat where the asphalt is hard and flow resistant, either because a relatively hard grade was used or because of extensive weathering. In such circumstances, it is believed, the cracks are initiated by internal stresses developed by the combined effects of the increased stiffness and reduction in volume of the asphaltic top coat that are associated with low temperatures during the cold part of the daily temperature cycle and particularly during the winter months. At some undetermined temperature the asphalt stiffens to a level such that the top coat no longer can accommodate the volume reduction and a crack occurs. This crack continues to grow when healing is insufficient during the higher temperatures of the daily and seasonal cycles because the asphalt present has insufficient cold flow.

The invention contemplates variously applying a quantity of a preferred hydrocarbon 7, described below, to either or both interior and exterior surfaces of the blistered portions 3 as by injection, spraying, mopping, or otherwise. Also contemplated is applying the hydrocarbon 7 to the outer surface of the membrane 1 for inhibiting the formation of blisters therein and for treatment and correction of cracked portions 4 occurring therein. For either blistered portions 3 or cracks 4, external pressure can be applied to the site thereof to urge the separated portions into rebonding contact.

What is required is a hydrocarbon 7 which has the ability to soften relatively hard asphalt and increase the cold flow characteristics. It is preferred that the hydrocarbon be relatively thin to penetrate and soften the plies yet have a desired relatively high flash point for safety in working with the material. Where the hydrocarbon is too light or volatile, unless a sufficently low quantity thereof is used, it may cause too much thining of the asphalt composition which would weaken the binding and strength characteristics of the roofing material. Preferred hydrocarbons are the relatively aromatic, low viscosity and low volatility petroleum solvent fractions such as thermally cracked gas oils, high boiling fractions of catalytically cracked gas oil, high boiling fractions of cracking cycle stocks, residues from pyrolysis of residual petroleum fuel oils used in the production of gas and oil and the like; and extracts from lube oil refining operations. Preferred members of the latter group include the high boiling obtained by use of nonreactive polar, somewhat aromatically preferential solvents such as liquid sulfur dioxide, phenol, cresylic acid, betadichloroethyl ether, nitrobenzene, etc. The use of the so called double solvent process implying mutually immiscible solvents such as cresylic acid and propane also yields suitable extracts. The useful hydrocarbon fractions may contain paraffinic unsaturated and naphthenic compounds.

The preferred hydrocarbon fractions have relatively low viscosities for penetration into the membrane 1 and range from about 25 SSU at 210° F. to about 400 SSU at 210° F. A specific gravity 60/60 exceeding 0.95 and preferably above 1.0 to be water displacing is desired. The hydrocarbon compositions preferably have minimum viscosity gravity constants of 0.92 and a maximum saturate limit of 35%, such as ASTM D-2007 or its equivalent. Accordingly, the maximum acceptable quantity of normal heptane insoluable compounds is approximately 4.0%, such as ASTM D-3279. Although not affecting the operability of the hydrocarbon to increase self-healing of the roof asphalt, for safety in working therewith and to prevent excessive fuming, it is preferred that the hydrocarbon have a low volatility index, such as an initial flash point (Cleveland Open Cup) over 250° F.

The addition of such hydrocarbon to oxidized, brittle or hard asphalt in an asphaltic membrane 1 to be treated, increases the cold flow characteristics thereof and enables the asphhalt of the membrane to have increased self-healing under normally encountered temperatures and pressures. Such self-healing both reduces and smooths cracks and inhibits blister formation and reverses such blister formation where once begun. In essence, once properly modified by the preferred hydrocarbon 7, the cracked portion 4 and the blistered portion 3 become self-healing that is, the rate of healing or bonding, proceeds more quickly than the rate of separation formation.

Treament with the hydrocarbon 7 instills self-healing properties in either an asphaltic membrane 1 hardened by exposure to the weather, heat, and aging or in a membrane 1 containing a hard roofing asphalt grade. In the later example, Type III and Type IV ASTM D-312-71 asphalts, known as steep grades, resist the flow and slip imposed by roofs having slopes as high as six inches to the foot. The use of Type III and Type IV roofing asphalts on low pitch and level roofs contribute to blistering and cracking.

The preferred hydrocarbon 7 is miscible with hard and hardened asphalts and produce blended compositions which have increased cold flow characteristics but are remarkably free from any substantial evidence of component migration. Although the component characteristics set forth above define a hydrocarbon which performs properly when applied to roofing asphalt, other tests to define the preferred hydrocarbon are not precluded. For example, penetration, ductility, boiling point, percent aromatics, aniline point, or other parameters may be used if desired. What is required of the preferred hydrocarbon 7 when blended with the asphalt component of the membrane is that it produce a composition that is glossy, relatively clean, and stable with little oily exudation. What is not acceptable are hydrocarbons that, when applied to roofing asphalt, tend to produce "gel like" and "cheesy" blends which have poor cold flow characteristics and suffer from relatively rapid loss of components through volatilization, migration, exudation, extraction or other mechanisms and weathers rapidly.

Excess syneresis or oily exudation typically hinders cold flow. As an empirical guide, the maximum acceptable amount of exudation should be no more than approximately 15 at 140° F./72 hours, ASTM D-1328, (Modified by Hveem, Zube and Skog, American Associated of Paving Technologists Proceedings, Vol. 32, pp. 298–300 (1963)), when the preferred hydrocarbon is in a 20% by volume blend with typical Type IV ASTM D-312-71 asphalt. Commensurately, the 20% by volume blend with typical Type IV asphalt, to exhibit proper cold flow characteristics, must have a flow of at least approximately 2.0 CM at 120° F./5 hours, ASTM D-1191, para. 5 (modified).

Field experience confirms the effectiveness of treatment of a membrane with the preferred hydrocarbon. In one instance, where samples were cut from a surface treated blister in which the asphalt component thereof before treatment had a ring and ball softening point of approximately 220° F., after treatment the blister top coat asphalt had a softening point of approximately 126° F. Asphalt from the felt ply portions of the blister had a softening point of approximately 185° F. Where tensile strength (ASTM D-2523-70) of the roof prior to treatment was 280 lbs. at 0° F., after treatment, the tensile strength of the roof increased to 400 lbs. In another instance, samples were tested from a treated roof in which top coat surface cracks were successfully reduced. The untreated asphalt had a 200° F. ring and ball softening point, which decreased after treatment to 133° F. in the top coat and 162° F. in the lower felt and asphalt plies. Similarly, the untreated roof had a tensile strength of 270 lbs., which increased after treatment to 340 lbs.

Although as previously described, the hydrocarbon 7 may be applied to the membrane 1 by the use of various fluid distributing equipment, such as mops, brushes, spreaders, and the like to treat cracked portions 4 and blistered portions 3, a particular form of fluid emitting apparatus 5 is illustrated in FIG. 1 which is useful to apply the hydrocarbon to the blistered portion 3. The fluid emitting apparatus 5 includes an elongated hollow rod or injection needle 22 extended through the top coat 15 and the top felt ply 14 and into the blister void 17. The injection needle 22 has a puncturing chisel tip 23, an elongated straight portion or shank 24 and an upwardly curved or bent portion 25. In the illustrated example, the injection needle 22 is connected to a combination handle and material valve 30 which in turn is operably connected by a flexible conduit or hose 32 to a pump means 35. The pump means 35 is of virtually any suitable type, such as an air motor, a gasoline operated engine, or as illustrated herein, an air motor in combination with a material holding tank device 34 for containing the preferred hydrocarbon 7. The hydrocarbon 7 is preferably applied at ambient air temperatures above 60° F., such as typical summer temperatures, for improved penetration of the hard asphalt in the membrane 1 and thus normally requires no special heating means such as frequently called for in asphalt operations. When using an air motor pump 35, an air supply hose 36 is included which is connected to an air supply source (not shown).

One of several methods of application of the hydrocarbon 7 for treating the membrane 1 is selected after examination of the condition thereof. One method of treatment is to inject the hydrocarbon 7 into the blistered portion 3. In the illustrated example, the injection needle is manually thrust into the side of the blistered portion 3 so that the chisel tip 23 punctures the blistered surface 19 and extends through the top coat 15 and the top felt ply 14 and into the interply blister void 17.

Figure 3:
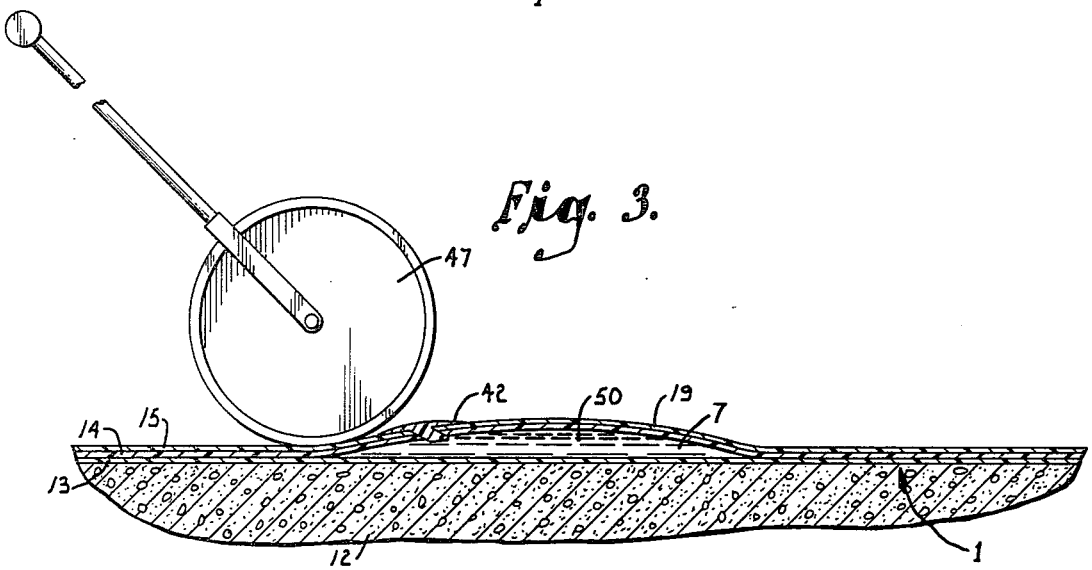
FIG. 3 is a fragmentary sectional view similar to FIG. 2 and showing a roller applying pressure to a blistered membrane surface.

Any large quantities of water trapped in the void 17 such as are present are expressed by walking on the surface 19 or otherwise applying pressure thereto. After voiding any large quantities of water through the puncture hole, a quantity of hydrocarbon 7 is injected thereinto, the preferred quantity being approximately four to five ounces by weight per square foot of area to be treated where a membrane of conventional thickness is involved. The quantity is measured by various and conventional methods; where an air pump is used, as in the illustrated example, the quantity of fluid delivered by a single stroke of the pump piston is measured and that amount divided into the desired area for treatment to determine the number of piston strokes to be counted. Upon injection into the void 17, the relatively high specific gravity of the preferred hydrocarbon 7 and an afffinity of the same for the asphalt permits the hydrocarbon 7 to displace any liquid water retained in the void 17. The hydrocarbon 7 penetrates the weathered and hard asphalt and asphalt impregnated roofing felts in the membrane 1 to soften the asphalt therein to a flowable condition by blending therewith an instilling cold flow properties sufficient for proper self-healing. After injection, foot pressure is applied to the blistered surface 19 to evenly distribute the hydrocarbon 7 in the void 17 and allow the fluid to contact and penetrate the affected areas. After withdrawing the needle 22, a mastic patch 42, as illustrated in FIG. 3, composed of, for example, mastic asphalt or the like, is applied to the puncture 43 to seal the same and prevent rainwater from entering thereinto.

The blistered portion 3, treated as described above, is left without further action for several days to permit the preferred hydrocarbon 7 to penetrate and soften the hardened asphalt. After this period, pressure is applied, if necessary, to the blistered portions 3 to urge the separated plies into rebonding contact and close top coat cracked surfaces. The pressure device need not be of the mechanical type and includes such diverse forms as workmen's foot pressure, weights, and the like, and is herein illustrated by way of example as a conventional roller 47. Depending on the extent of rebonding after the first pressure applications, a second rolling may be required after serveral more days have elapsed after the application of the hydrocarbon 7. Note that, as illustrated in FIG. 3, the blister 50 is smaller in size than the blistered portion 3 of FIG. 1 and rebonding has occurred as the pressure applying roller 47 passed thereover.

Another practice of the invention is illustrated in FIG. 4 whereby the fluid emitting apparatus 5 directs a quantity of the preferred hydrocarbon 7 over the blistered surface 19 of the membrane 1 or over the entire roof with the blisteres under treatment. For such surface treatments other modes of distributing the preferred hydrocarbon 7 over the blister 19 and membrane 1 such as spraying, brushing or mopping (not shown) are satisfactory practices. The quantity of the hydrocarbon 7 applied over the blistered surface 19 or the entire roof surface 1 is aproximately four to five ounces per square foot of surface area. Other quantities may be used depending on the amount and porosity of the aggregate within the top coat 15. In this mode of treatment also, the hydrocarbon 7 penetrates and softens the asphalt of the hardened and separate plies to a flowable condition by instilling self-healing qualities of the asphalt in the plies. The hydrocarbon 7 is applied and permitted to penetrate into the blistered surface or surfaces 19 for several days or even weeks to re-establish bonding contact. Depending upon the condition of the membrane 1 before treatment and roof temperature, rebonding may take place due to the weight of overlying plies contacting each other once softened. However, gentle rolling, as by the roller 47, may be used as an aid to bonding. During surface treatment it is preferred that the blistered surface 19 can be punctured by the fluid emitting apparatus 5 or by conventional sharp-tipped tools (not shown) to deflate the blister and aid rebonding.

One suitable practice of the invention is illustrated in FIG. 5 which is a combination of the above alternate practices described in connection with FIGS. 1-4. In this practice, the hydrocarbon 7 is both injected into the blister void 17 and spread over the blistered surface 19 or over the entire membrane 1 in question to provide maximum rate of healing and most effectively rebond the separated plies. After sufficient time has passed to permit the asphalt to soften, it is preferred that the surface 19 be rolled as described above.

Another preferred practice of the invention is that illustrated by FIG. 4 but where a portion of the total quantity of the preferred hydrocarbon 7 approximating 4 to 5 oz. per square foot of surface area is applied over membrane 1 that includes blisters under treatment. The mode of application can be with apparatus 5 or other satisfactory methods such as spraying, brushing, or mopping (not shown). The partial initial application is allowed to penetrate and soften the top coat 15 and roofing felt ply 14 so that the blister is soft and pliable. In this condition the blister is punctured with a sharp instrument (not shown) and deflated by foot pressure or other means as already discussed. In the softened condition the top coat 15 and roofing felt ply 14 more completely conform to the ply 13, a condition conducive to the correction of the blistered membrane. The remainder of the desired quantity of the preferred hydrocarbon 7 is then applied to complete the treatment. Sealing the puncture with mastic as already described, once the blister is deflated is a preferred practice.

The treatment can be used on a roof to prevent the occurrence of blisters therein by utilizing the fluid emitting apparatus 5 or brushes, mops, sprays or the like to direct a quantity of the hydrocarbon 7 over the membrane 1. This method instills self-healing qualities into the asphalt of the membrane 1 so that blistering or cracking does not occur. The quantity of the preferred hydrocarbon 7 applied varies with the thickness and area of the membrane 1 to be treated, however, where the membrane is of conventional thickness, approximately four to five ounces by weight per square foot of roof surface is recommended.

It is to be noted that several factors are involved in the application of the hydrocarbon 7 and improvements in self-healing will not necessarily be noticed until the hydrocarbon 7 has sufficiently penetrated into the membrane 1. The rate of penetration is a function of the viscosity of the preferred hydrocarbon (from 25 to 400 SSU at 210° F.) and the time and roof temperature at the time it is applied.

It is to be understood that while certain forms and practices of this invention have been illustrated and described, it is not to be limited thereto except insofar as such limitation are included in the following claims.

What is claimed and desired to secure by Letters Patent is:

1. A method of healing blisters in a multi-ply asphaltic membrane covered roof having a top coat and roofing felt ply therebeneath with the blister voids extending beneath the roofing felt ply, and inhibiting the further formation of such blisters therein, said method including the step of:

(a) applying over the entire membrane area containing said blisters a quantity of liquid petroleum hydrocarbon at a rate to total approximately 4 to 5 ounces by weight per square foot of surface area of membrane treated, said hydrocarbon having no more than 4.0% normal heptane insoluble compounds, a viscosity from 25 SSu to 400 SSU at 210° F., a minimum viscosity-gravity constant of 0.92, a specific gravity of 60/60 exceeding 0.95, an initial flash point (Cleveland Open Cup) approximately over 250° F., and a maximum saturate constituent limit of 35%; said hydrocarbon being miscible with asphaltic components of said membrane to penetrate same;

(b) applying said hydrocarbon at ambient air temperatures above about 60° F., and (c) maintaining said hydrocarbon on said membrane area to penetrate said top coat and roofing felt, whereby the rate of healing proceeds more quickly than the rate of separation.

2. The method as set forth in claim 1, including:

(a) puncturing and emptying the contents of said blisters prior to said application.

3. The method as set forth in claim 2, including:

(a) applying mastic patches over the puncture.

* * * * *